US007841480B2

(12) United States Patent
Hsieh

(10) Patent No.: US 7,841,480 B2
(45) Date of Patent: Nov. 30, 2010

(54) SOCKET HOLDING DEVICE

(76) Inventor: Chih-Chien Hsieh, No. 10, Lane 715, Tung-Ping Rd., Tai-Ping City, Taichung Hsien (TW)

( * ) Notice: Subject to any disclaimer, the term of this patent is extended or adjusted under 35 U.S.C. 154(b) by 206 days.

(21) Appl. No.: 12/211,320

(22) Filed: Sep. 16, 2008

(65) Prior Publication Data

US 2010/0065520 A1 Mar. 18, 2010

(51) Int. Cl.
*A47F 7/00* (2006.01)

(52) U.S. Cl. ..... 211/70.6; 206/378; 403/328

(58) Field of Classification Search ..... 211/70.6, 211/69.5; 206/378, 375, 376; 403/328, 325; 81/177.85; 410/104–106; 248/309.2
See application file for complete search history.

(56) References Cited

U.S. PATENT DOCUMENTS 5,228,570 A * 7/1993 Robinson ..... 206/378
5,544,747 A * 8/1996 Horn ..... 206/378
5,593,265 A * 1/1997 Kizer ..... 411/552
5,743,395 A * 4/1998 Backer ..... 206/378
7,066,055 B1 * 6/2006 Lee ..... 81/63

* cited by examiner

*Primary Examiner*—Korie Chan
(74) *Attorney, Agent, or Firm*—Frommer Lawrence & Haug LLP; Ronald R. Santucci

(57) ABSTRACT

A socket holding device includes a peg component, a holding component, a positioning component, and a spring component. The peg component has a pin portion formed with a recess. The holding component has an insert portion that is movable between first and second positions relative to the pin portion. The insert portion has an outer peripheral wall that permits sleeving of a socket on the holding component. The insert portion is formed with a retainer hole that is registered with the recess. The positioning component is movably disposed in the retainer hole. The positioning component and the recess are configured such that the positioning component projects from the outer peripheral wall for interference engagement with the socket when the holding component is at the first position, and such that the positioning component permits removal of the socket when the holding component is at the second position. The spring component biases the holding component to the first position.

6 Claims, 10 Drawing Sheets

SOCKET HOLDING DEVICE

BACKGROUND OF THE INVENTION

1. Field of the Invention

The invention relates to a socket holding device, more particularly to a socket holding device that incorporates secure and quick release features.

2. Description of the Related Art

FIGS. 1 and 2 show a conventional socket holding device 1 capable of holding a socket (not shown). The socket holding device 1 includes a base member 11, a pin member 12, a holder 13, a spring member 14, and a ball 15. The base member 11 has a slot 111 provided for sliding engagement with the holder 13. The pin member 12 is an inverted cone shape defined by an increased curvature section and a reduced curvature section. The pin member 12 extends through the holder 13 so as to be mounted on the base member 11. The pin member 12 is further formed with a flat portion 121 and a conical portion 122. The spring member 14 is mounted on the base member 11 and is sleeved on the pin member 12. The ball 15 is positioned against the pin member 12 and rotates in relation to the pin member 12 between the reduced curvature section when the holder 13 is at a releasing position, and the increased curvature section when the holder 13 is at a locking position. The holder 13 defines a ball slot 131 that allows the ball 15 to move vertically therealong.

During installation of the socket (not shown) onto the socket holding device 1 (locking position), the ball 15 presses against and moves along the conical portion 122 of the pin member 12. When the installing force applied on the socket is removed, the ball 15 moves along the conical portion 122 of the pin member 12 and is retained between the socket and the conical portion 122, thereby holding the socket on the holder 13.

To remove the socket (not shown) from the socket holding device 1, the holder 13 is rotated in relation to the pin member 12 to the releasing position so that the ball 15 is moved from the conical portion 122 to the flat portion 121. Thus, the ball 15 is retracted into the ball slot 131 for easy removal of the socket.

One problem associated with the conventional socket holding device 1 is that since the ball 15 is wedged between adjacent turns of the spring member 14, the ball 15 may not be able to move resiliently along the pin member 12 if the spring member 14 deteriorates in strength after a period of time. As a result, the socket holding device 1 may not be able to retain the socket properly.

SUMMARY OF THE INVENTION

Therefore, it is an object of the present invention to provide a socket holding device that can overcome the above drawbacks of the prior art.

According to the invention, a socket holding device is adapted for retaining a socket thereon and includes a peg component, a holding component, a spring component, and a positioning component.

The peg component has a pin portion that defines a pin axis and that has a pin surface, and a recess that is formed in the pin surface and that extends parallel to the pin axis. The holding component has an insert portion formed with a through-hole to permit extension of the pin portion into the insert portion. The holding component is movable between first and second positions relative to the pin portion along the pin axis. The insert portion has an outer peripheral wall corresponding in dimensions to the socket for permitting sleeving of the socket on the holding component. The insert portion is further formed with a retainer hole that extends from the outer peripheral wall into the through-hole and that is registered with the recess. The positioning component is movably disposed in the retainer hole and extends into the recess. The positioning component and the recess are configured such that the positioning component projects from the outer peripheral wall for interference engagement with the socket when the holding component is at the first position, and such that the positioning component is retracted into the retainer hole to permit removal of the socket from the holding component when the holding component is at the second position. The spring component biases the holding component to the first position.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
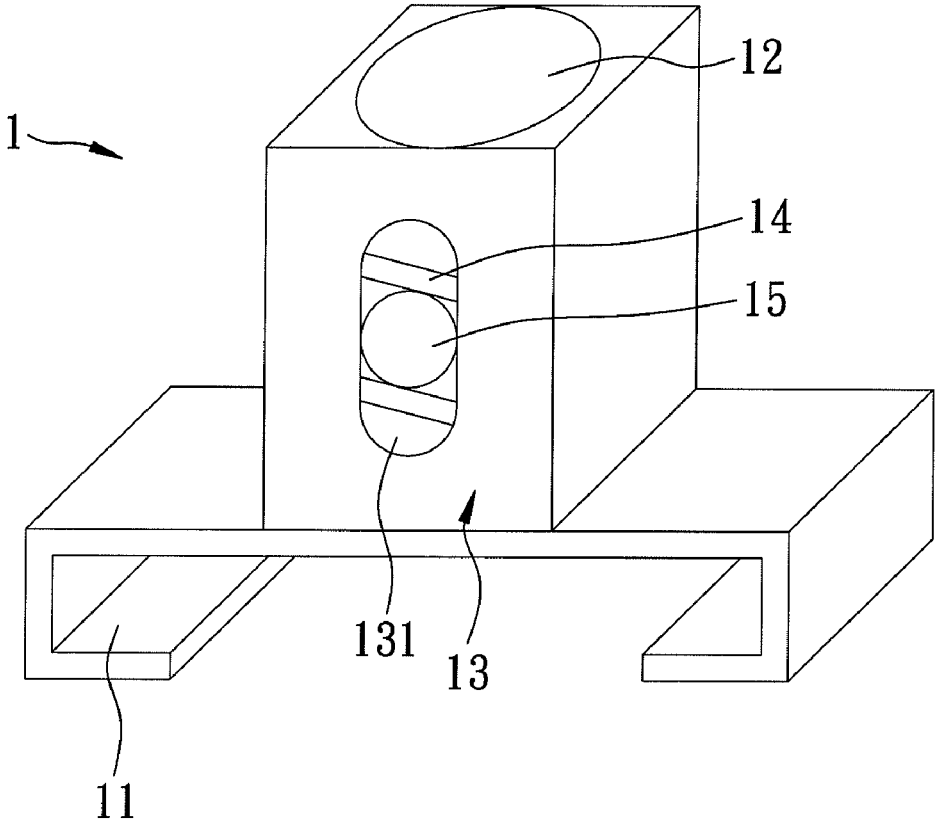
FIG. 1 PRIOR ART
FIG. 1 is a perspective view of a conventional socket holding device.
Figure 2:
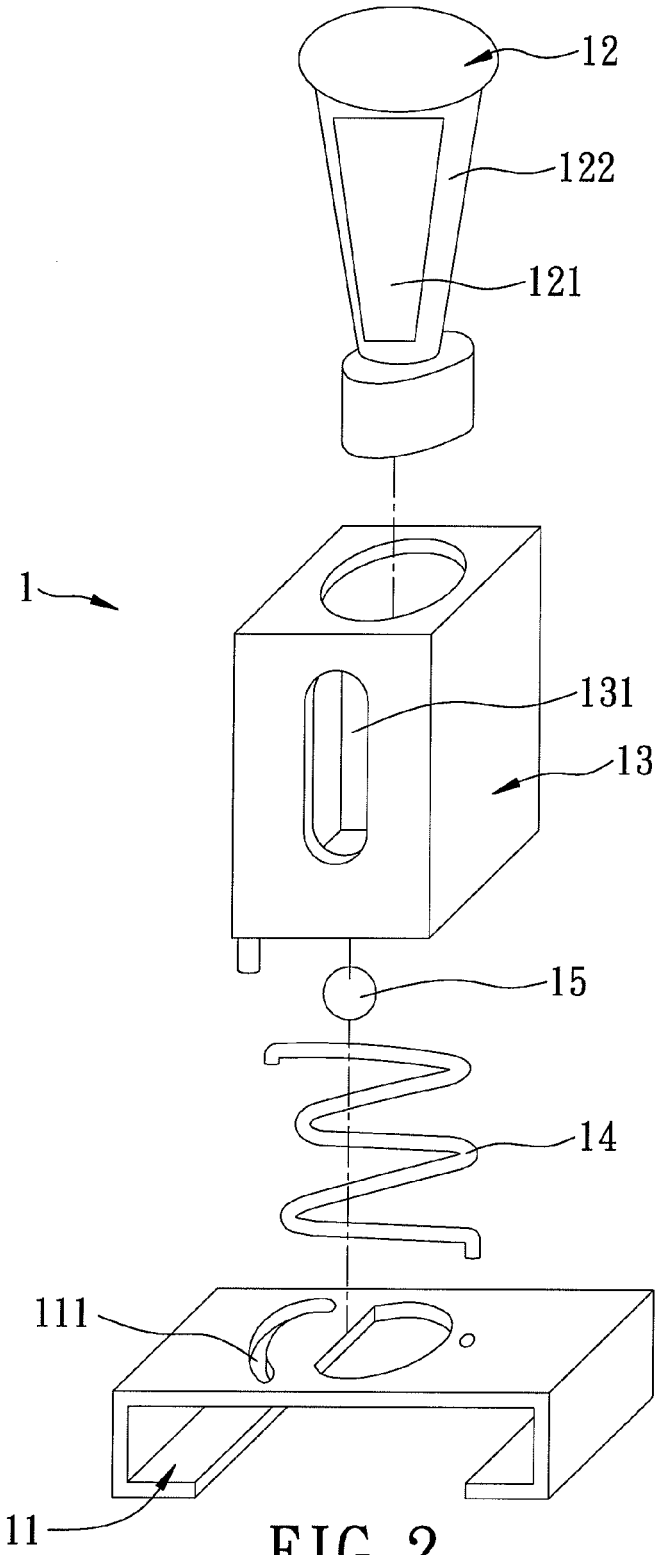
FIG. 2 PRIOR ART
FIG. 2 is an exploded perspective view of the socket holding device shown in FIG. 1.
Figure 3:
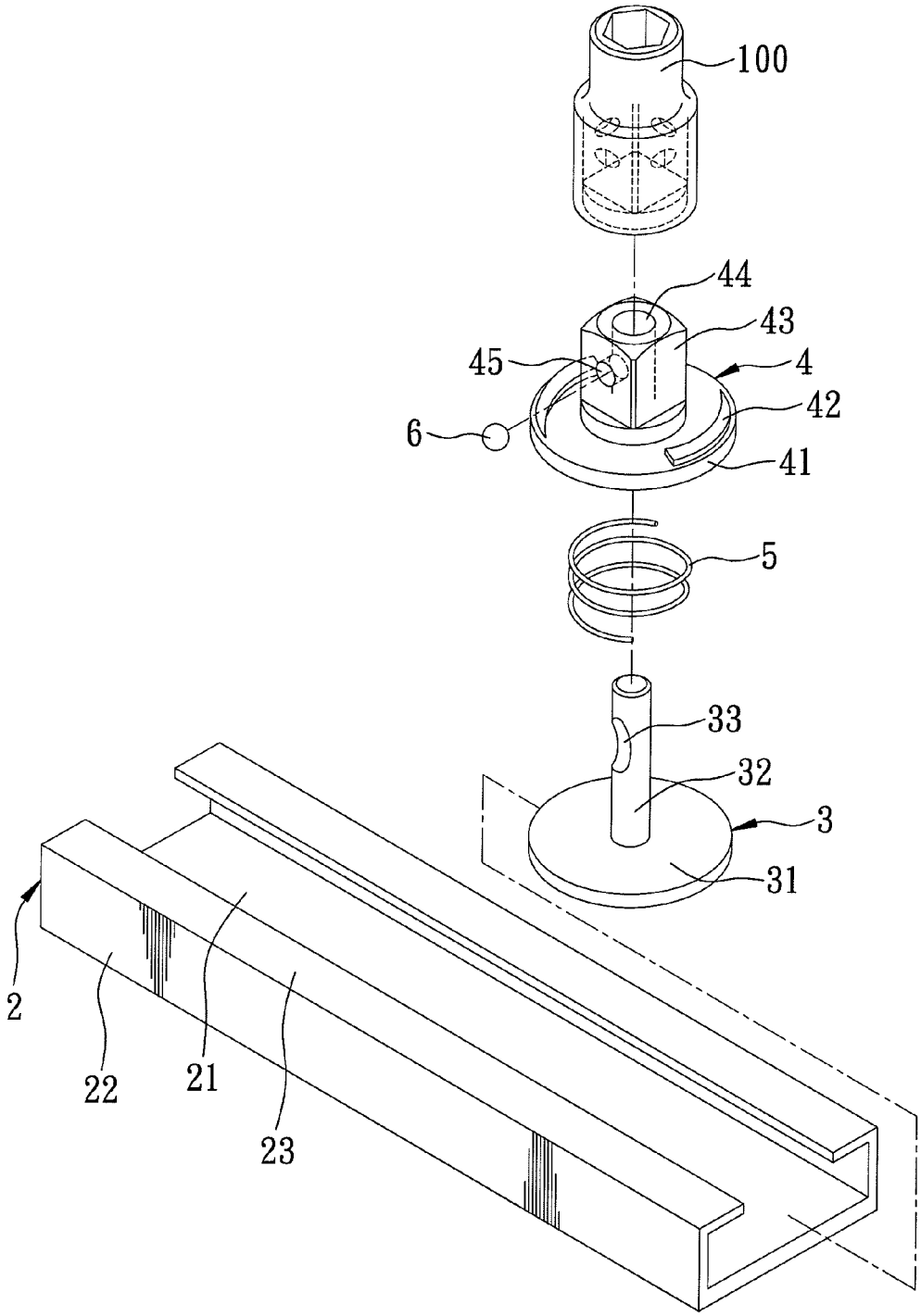
FIG. 3 is an exploded perspective view of the first preferred embodiment of a socket holding device according to the present invention.
Figure 4:
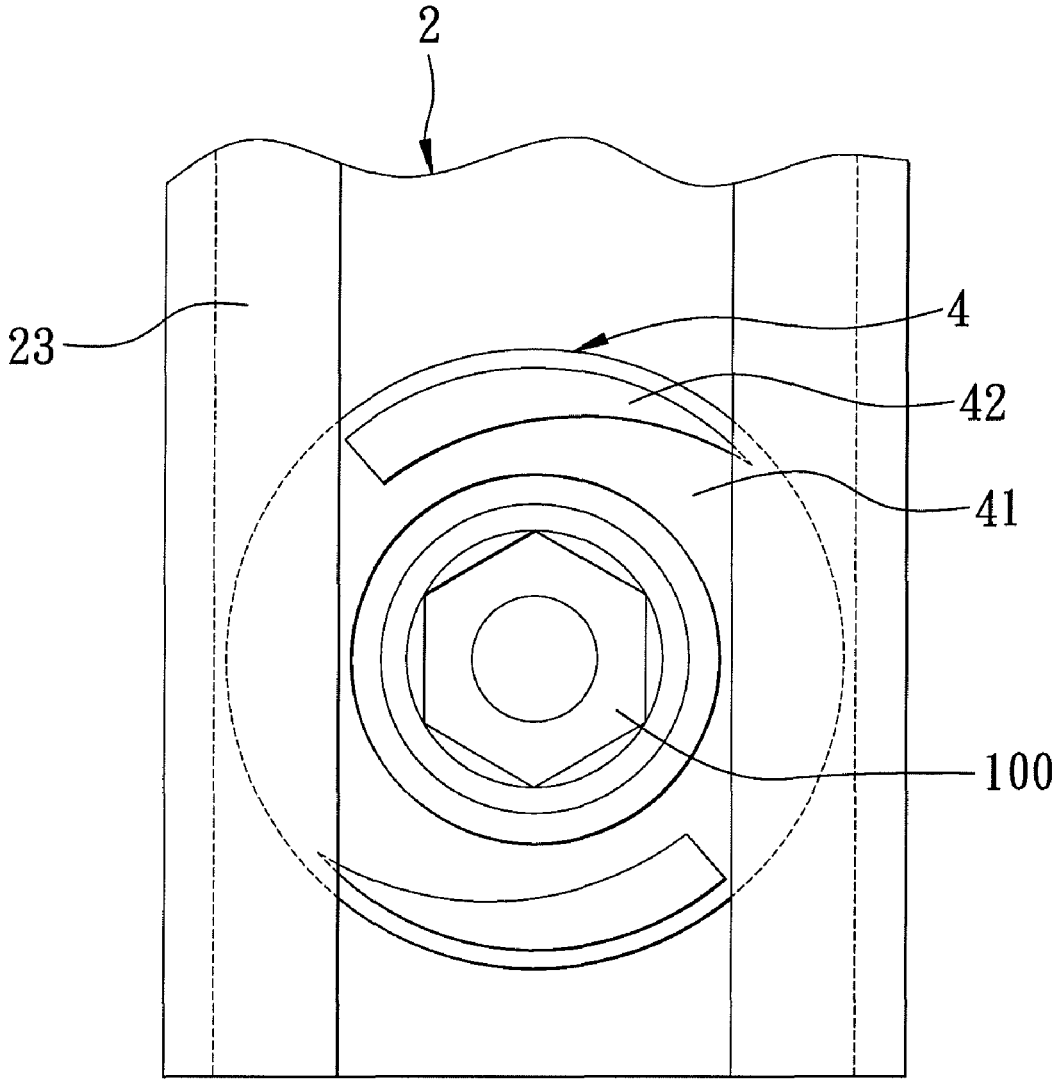
FIG. 4 is a fragmentary top view of the socket holding device in a locking state.
Figure 5:
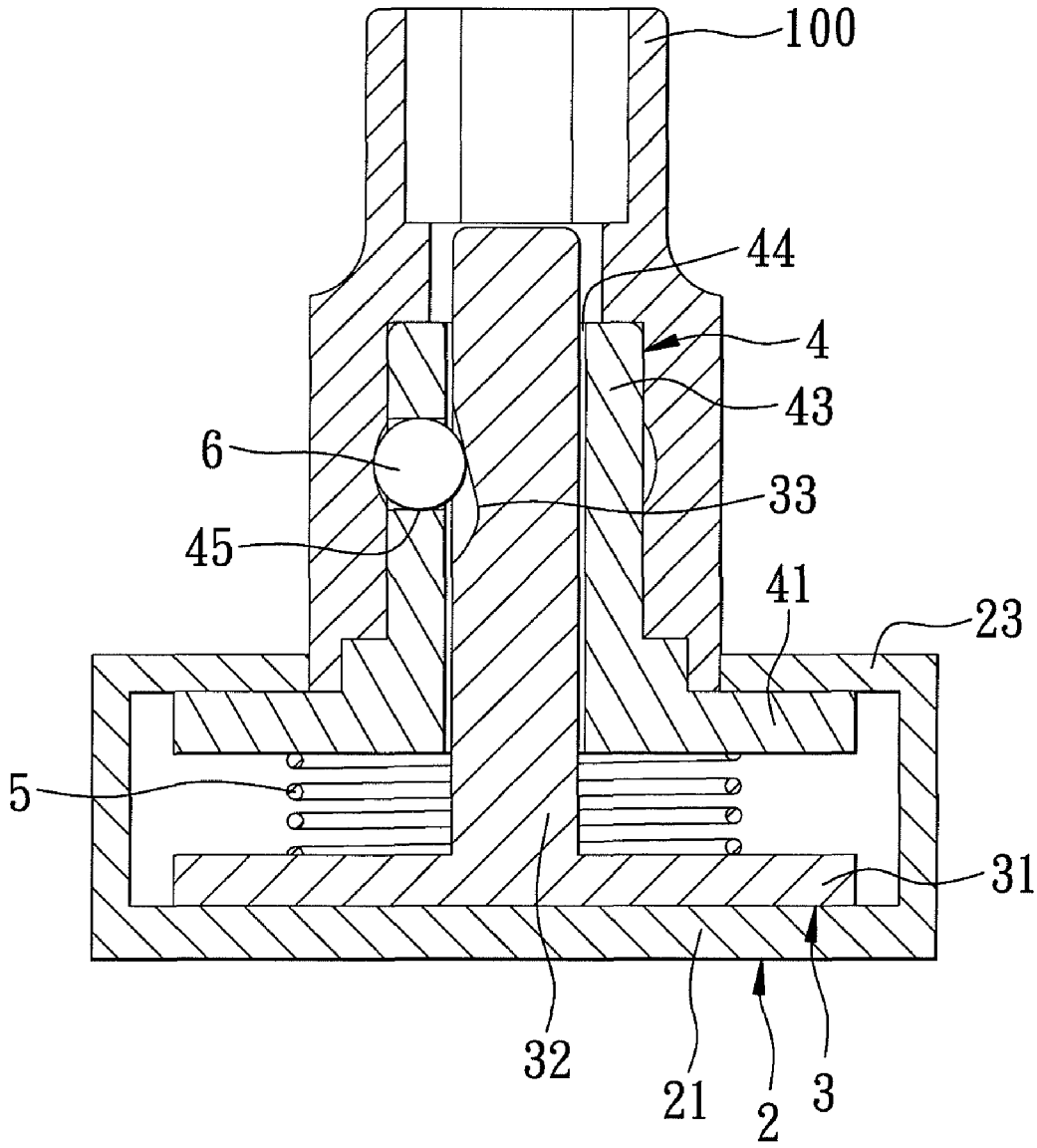
FIG. 5 is a cross-sectional view of the socket holding device in the locking state.
Figure 6:
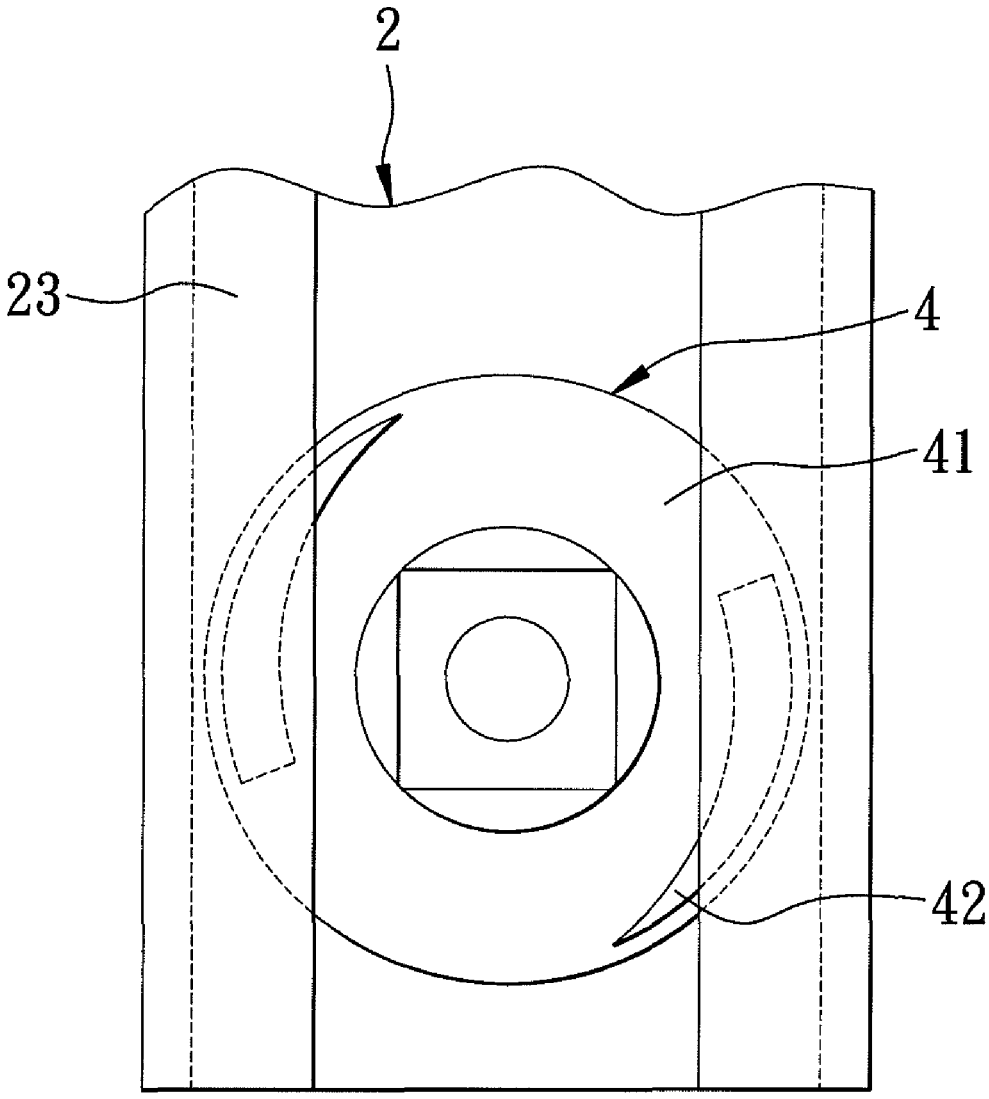
FIG. 6 is a fragmentary top view of the socket holding device in a releasing position.
Figure 7:
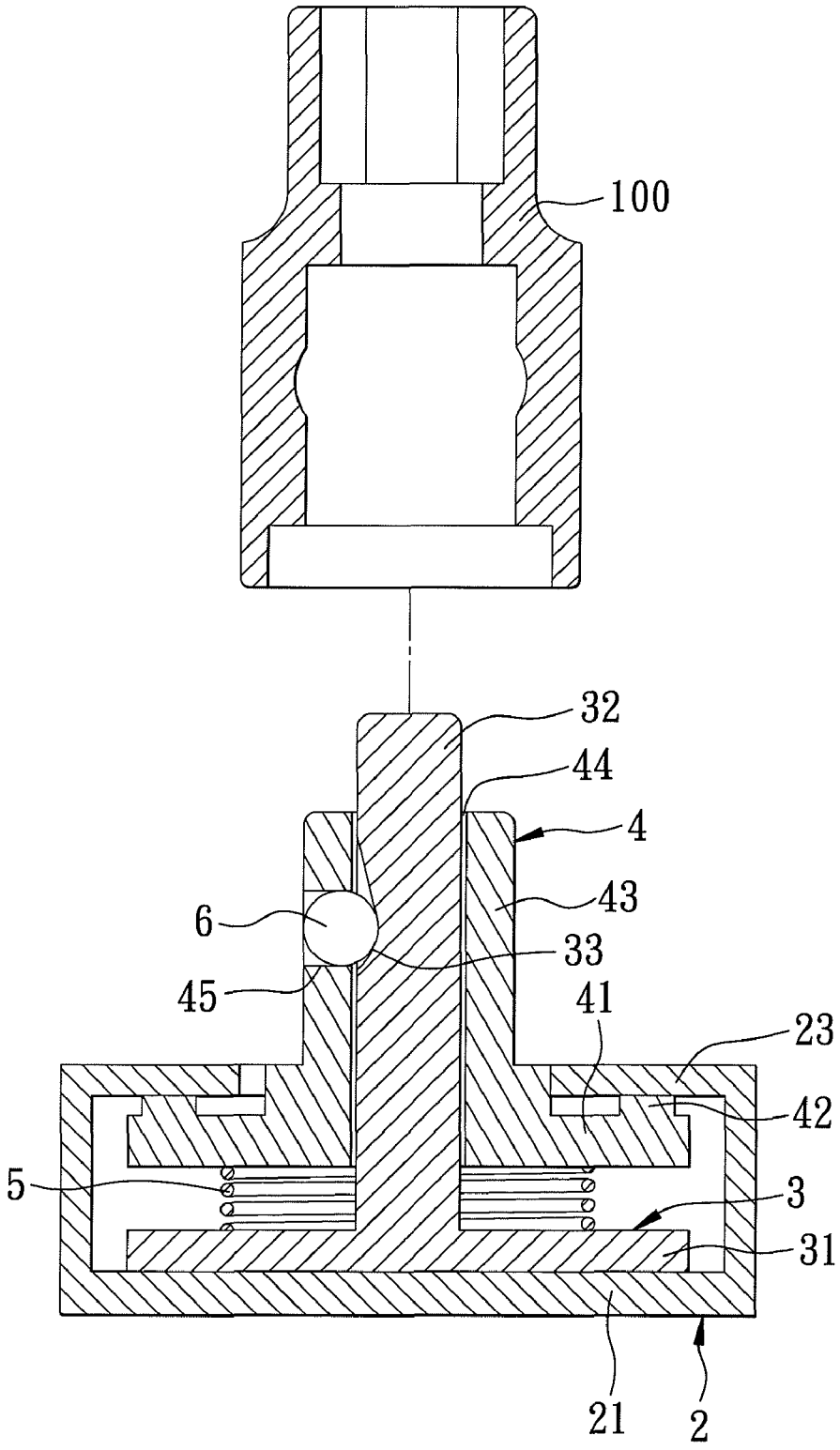
FIG. 7 is a cross-sectional view of the socket holding device in the releasing position.
Figure 8:
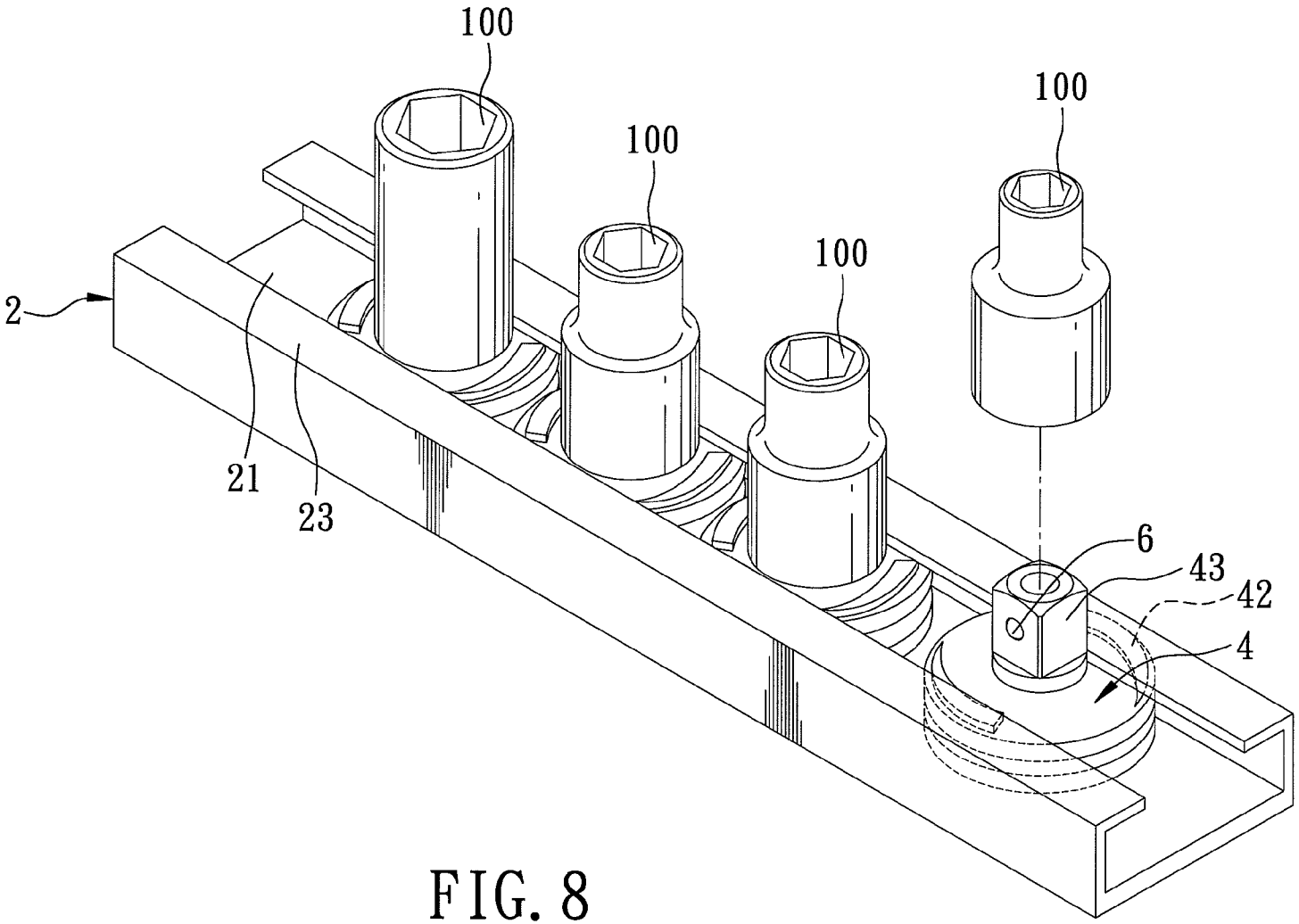
FIG. 8 is a perspective view of the first preferred embodiment in a state of use.

Referring to FIGS. 3 to 8, the first preferred embodiment of a socket holding device according to the present invention is adapted for retaining a socket 100 thereon. The socket holding device includes a track member 2, a peg component 3, a holding component 4, a spring component 5, and a positioning component 6.

The peg component 3 has a pin portion 32 that defines a pin axis and that has a pin surface, and a recess 33 that is formed in the pin surface and that extends parallel to the pin axis. The peg component 3 further has a base portion 31 from which the pin portion 32 extends. The track member 2 extends in a lengthwise direction transverse to the pin axis, and includes a base wall 21 having opposite longitudinal sides, a pair of side walls 22 each of which extends from a respective one of the longitudinal sides parallel to the pin axis, and a pair of end walls 23 that extend toward each other from distal ends of the side walls 22, respectively. The base portion 31 of the peg component 3 is disposed on the base wall 21, and the pin portion 32 extends between the end walls 23 and outwardly of the track member 2.

The holding component 4 has an insert portion 43 formed with a through-hole 44 to permit extension of the pin portion 32 into the insert portion 43. The holding component 4 further has a plate portion 41 from which the insert portion 43 extends. The plate portion 41 of the holding component 4 is disposed between the end walls 23 and the base portion 31, and the insert portion 43 extends between the end walls 23 and outwardly of the track member 2. Further, the plate portion 41 of the holding component 4 has one side formed with a cam projection 42. The spring component 5 is disposed between the base portion 31 and the plate portion 41.

In this embodiment, the cam projection 42 is wedge-shaped, the spring component 5 is a compression spring, and the positioning component 6 is ball-shaped. The insert portion 43 has an outer peripheral wall corresponding in dimensions to the socket 100 for permitting sleeving of the socket 100 on the holding component 4. The insert portion 43 is further formed with a retainer hole 45 that extends from the outer peripheral wall into the through-hole 44 and that is registered with the recess 33.

The holding component 4 is movable between first and second positions relative to the pin portion 32 along the pin axis. The spring component 5 biases the holding component 4 to the first position. The positioning component 6 is movably disposed in the retainer hole 45 and extends into the recess 33. The recess 33 has a depth that increases in a direction toward the base portion 31 such that the recess 33 is formed with shallower and deeper sections. In this embodiment, the deeper section is located toward the base portion 31 and the shallower section is opposite to the deeper section. In addition, the holding component 4 is rotatable relative to the track member 2 between a locking position (see FIGS. 4 and 5), and a releasing position (see FIGS. 6 and 7). In the first position (see FIG. 5), the positioning component 6 projects from the outer peripheral wall for interference engagement with the socket 100. In the second position (see FIG. 7), the positioning component 6 is retracted into the retainer hole 45 to permit removal of the socket 100 from the holding component 4.

To secure the socket 100 onto the socket holding device, the holding component 4 is rotated to the locking position relative to the track member 2 so that the cam projection 42 is disposed between the end walls 23 and the spring component 5 biases the plate portion 41 to abut against the end walls 23, thereby locating the holding component 4 at the first position. The positioning component 6 and the recess 33 are configured such that the positioning component 6 projects from the outer peripheral wall and extends into the shallower section of the recess 33 for interference engagement with the socket 100 (see FIGS. 4 and 5).

To release the socket 100 from the socket holding device, the holding component 4 is rotated to the releasing position relative to the track member 2 so that the cam projection 42 is disposed between the plate portion 41 and said one of the end walls 23 to move the holding component 4 to the second position against biasing action of the spring component 5. The positioning component 6 is retracted into the retainer hole 45 and extends into the deeper section of the recess 33 for permitting removal of the socket 100 from the holding component 4 (see FIGS. 6 and 7).

Figure 9:
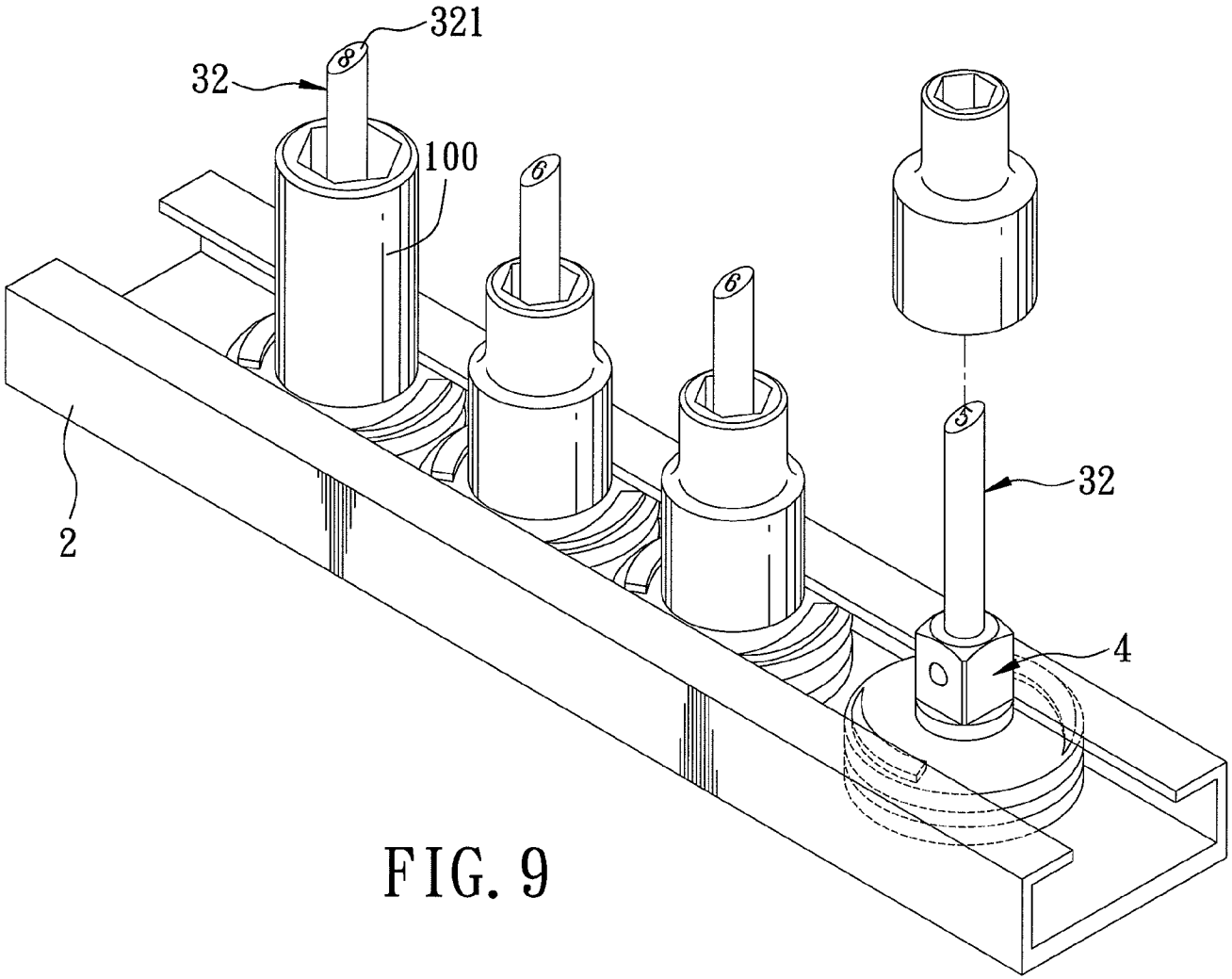
FIG. 9 is a perspective view of the second preferred embodiment of the socket holding device according to the present invention.

As shown in FIG. 9, the second preferred embodiment of the socket holding device according to the present invention has a structure similar to that of the previous embodiment. The main differences between this embodiment and the first preferred embodiment reside in the following. The pin portion 32 extends through the insert portion 43 and has a distal end face 321 distal from the base portion 31 and provided with indicia for indicating specification of the socket 100. The second preferred embodiment has the same advantages as those of the first preferred embodiment.

Figure 10:
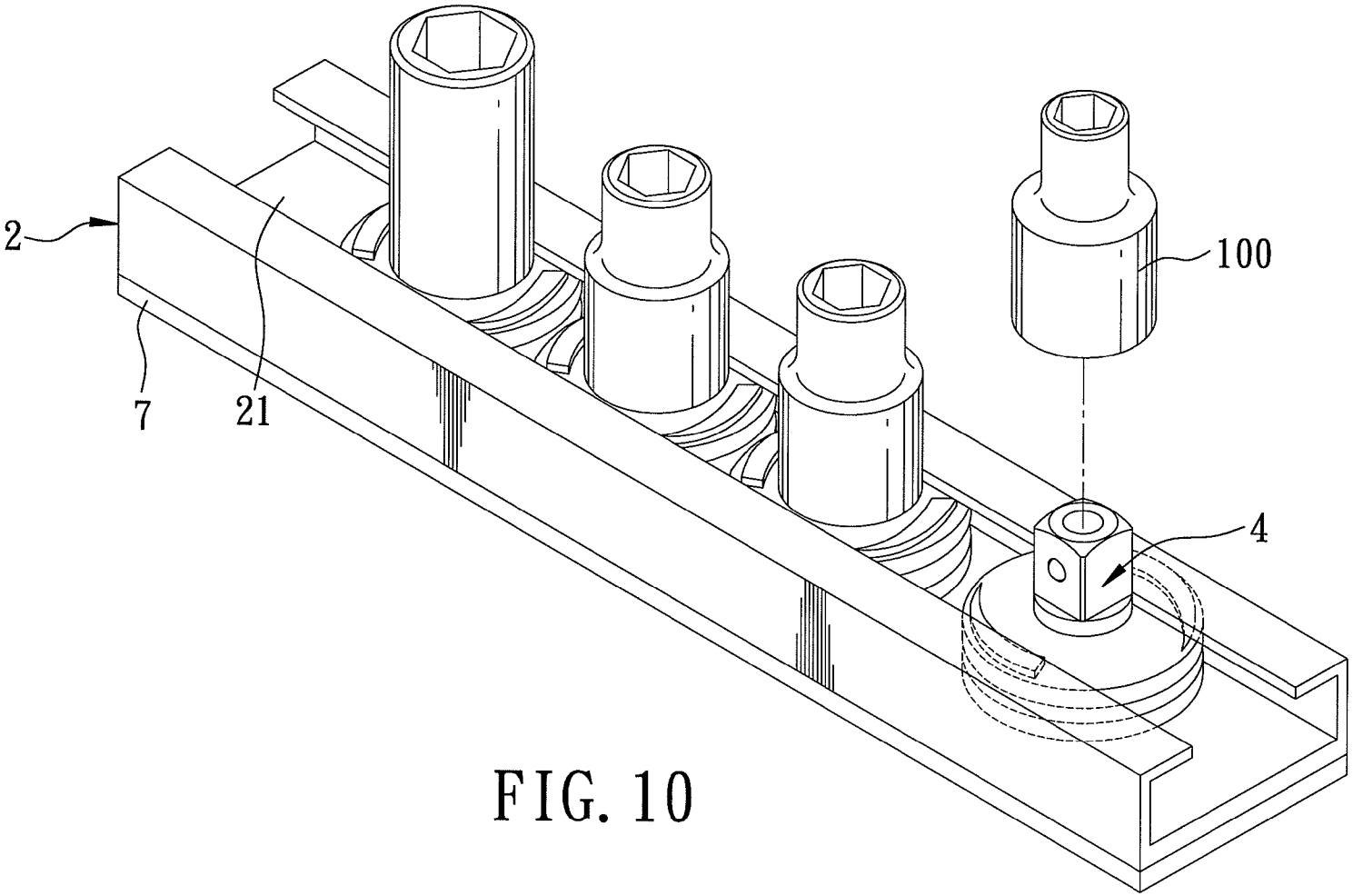
FIG. 10 is a perspective view of the third preferred embodiment of the socket holding device according to the present invention.

As shown in FIG. 10, the third preferred embodiment of the socket holding device according to the present invention has a structure similar to that of the first preferred embodiment. The main differences between this embodiment and the first preferred embodiment reside in the following. The track member 2 has a magnet member 7 attached thereto so that the track member 2 can be magnetically attracted to a metal object, e.g., a tool box. The third preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A socket holding device adapted for retaining a socket thereon, comprising:

a peg component having a pin portion that defines a pin axis and that has a pin surface, and a recess that is formed in said pin surface and that extends parallel to the pin axis;

a holding component having an insert portion formed with a through-hole to permit extension of said pin portion into said insert portion, said holding component being movable between first and second positions relative to said pin portion along said pin axis, said insert portion having an outer peripheral wall corresponding in dimensions to the socket for permitting sleeving of the socket on said holding component, said insert portion being further formed with a retainer hole that extends from said outer peripheral wall into said through-hole and that is registered with said recess;

a positioning component movably disposed in said retainer hole and extending into said recess, said positioning component and said recess being configured such that said positioning component projects from said outer peripheral wall for interference engagement with the socket when said holding component is at the first position, and such that said positioning component is retracted into said retainer hole to permit removal of the socket from said holding component when said holding component is at the second position; and a spring component for biasing said holding component to the first position;

wherein said peg component further has a base portion from which said pin portion extends, said holding component further 1 as a plate portion from which said insert portion extends, and said spring component is disposed between said base portion and said plate portion;

wherein said socket holding device further comprises a track member that extends in a lengthwise direction transverse to the pin axis, said track member including a base wall having opposite longitudinal sides, a pair of side walls each of which extends from a respective one of the longitudinal sides parallel to the pin axis, and a pair of end walls that extend toward each other from distal ends of said side wall, respectively;

wherein said base portion of said peg component is disposed on said base wall, and said pin portion extends between said end walls and outwardly of said track member;

wherein said plate portion of said holding component is disposed between said end walls and said base portion, and said insert portion extends between said end walls and outwardly of said track member; and wherein said plate portion of said holding component has one side formed with a cam projection, said holding component being rotatable relative to said track member between a releasing position, where said cam protection is disposed between said plate portion and one of said end walls and cooperates with said one of said end walls to move said holding component to the second position against biasing action of said spring component, and a locking position, where said cam projection is disposed between said end walls and said spring component biases said plate portion to abut against said end walls, thereby locating said holding component at the first position.

2. The socket holding device as claimed in claim 1, wherein said recess has a depth that increases in a direction toward said base portion such that said positioning component extends into a shallower section of said recess when said holding component is at the first position and into a deeper section of said recess when said holding component is at the second position.

3. The socket holding device as claimed in claim 2, wherein said positioning component is ball-shaped.

4. The socket holding device as claimed in claim 1, wherein said spring component is a compression spring.

5. The socket holding device as claimed in claim 1, wherein said pin portion extends through said insert portion and has a distal end face distal from said base portion and provided with indicia for indicating specification of the socket.

6. The socket holding device as claimed in claim 1, further comprising a magnet member attached to said track member.

* * * * *